United States Patent [19]

Putti

[11] 4,046,848

[45] Sept. 6, 1977

[54] EXTRUSION MACHINE FOR MAKING ARTICLES OF CEMENT-LIKE MATERIAL

[75] Inventor: George Putti, North Vancouver, Canada

[73] Assignee: Dyform Concrete (Prestressed) Ltd., Vancouver, Canada

[21] Appl. No.: 522,920

[22] Filed: Nov. 11, 1974

Related U.S. Application Data

[60] Continuation of Ser. No. 310,791, Nov. 30, 1972, abandoned, which is a division of Ser. No. 69,300, Sept. 30, 1970, Pat. No. 3,877,860, which is a division of Ser. No. 882,039, Dec. 4, 1969, abandoned.

[51] Int. Cl.[2] ..... B28B 1/08

[52] U.S. Cl. ..... 264/70; 264/71; 264/177 R; 425/64; 425/427

[58] Field of Search ..... 264/32, 33, 34, 312, 264/228, 70–72, 177; 425/63, 64, 59, 262, 426–428

[56] References Cited

U.S. PATENT DOCUMENTS

| | | | |
|---|---|---|---|
| 1,895,740 | 1/1933 | Ukropina | 264/312 X |
| 3,159,897 | 12/1964 | Ellis | 425/427 |
| 3,200,177 | 8/1965 | Dodd | 264/70 |
| 3,284,867 | 11/1966 | Booth | 425/114 |
| 3,363,042 | 1/1968 | Getman | 264/312 |

FOREIGN PATENT DOCUMENTS

| | | | |
|---|---|---|---|
| 623,264 | 6/1935 | Germany | 425/59 |

*Primary Examiner*—Thomas P. Pavelko
*Attorney, Agent, or Firm*—Fetherstonhaugh & Company

[57] ABSTRACT

An extrusion machine for continuously making articles, such as concrete slabs, by forcing the article-forming material through a mold, said machine being moved forwardly by reaction as the material is forced against the portion of the article already formed. The material is moved under pressure by one or more spiral conveyors through the mold, and a forming element of any predetermined cross-sectional shape is substantially aligned with the down-stream end of each spiral conveyor and is mounted so as not to rotate with the latter. It is preferable to provide a vibrator in each forming element.

7 Claims, 11 Drawing Figures

Figure 1:
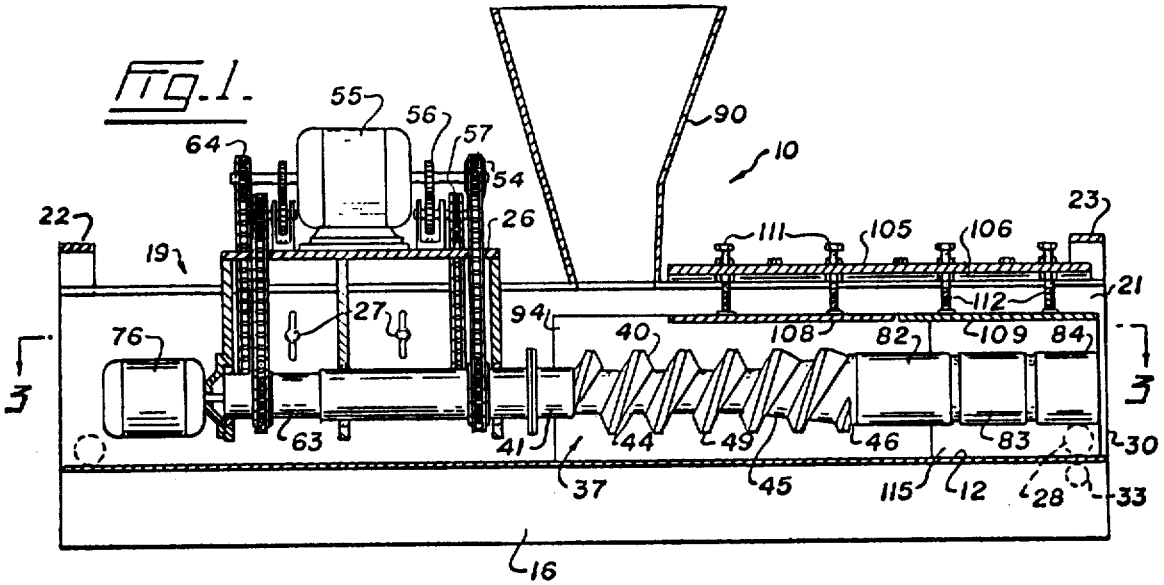

Fig. 3.
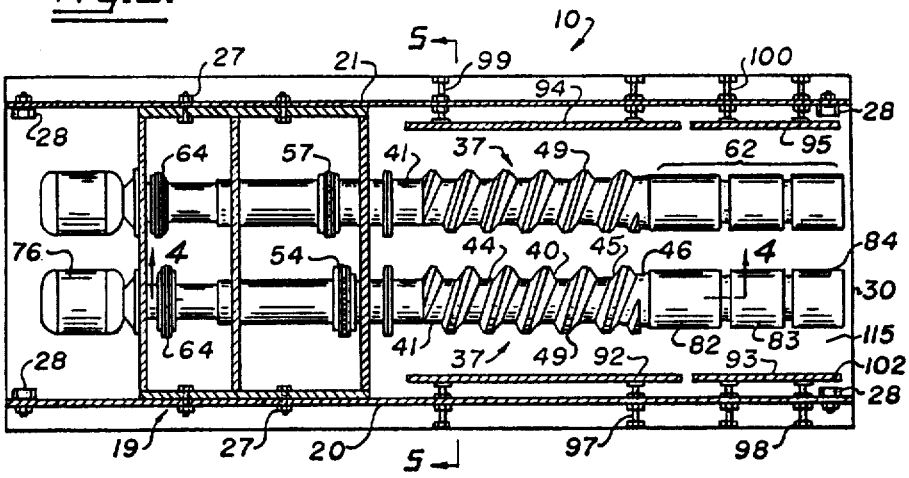
Fig. 4.
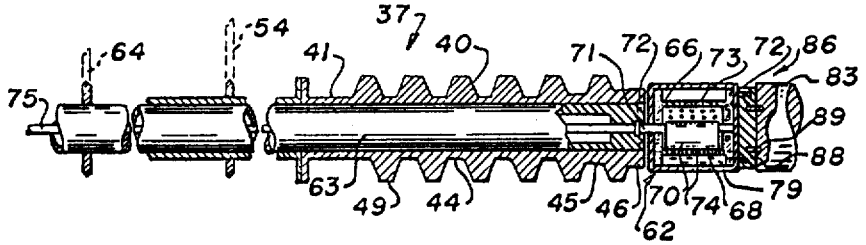
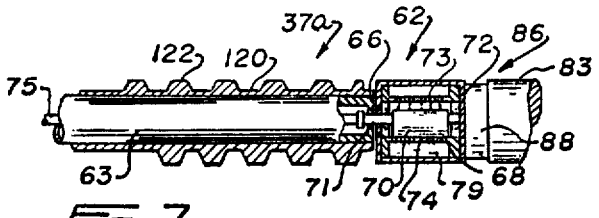
Fig. 7

EXTRUSION MACHINE FOR MAKING ARTICLES OF CEMENT-LIKE MATERIAL

This is a continuation, of application Ser. No. 310,791, filed Nov. 11, 1972 now abandoned which is a division of Ser. No. 69,300 filed Sept. 9, 1970 which is a division of Ser. No. 882,039, filed Dec. 4, 1969.

This invention relates to extrusion machines for making articles, such as slabs, panels, beams, and the like from suitable moldable material such as concrete. The moldable material used is a relatively stiff mix and rapidly sets to a relatively solid state. For the sake of convenience, the invention will be described herein relative to making cored slabs of concrete.

There are many machines in use for making by extrusion concrete slabs and other concrete articles. An example of the prior art machines is illustrated and described in U.S. Pat. No. 3,159,897, dated Dec. 8, 1964. This patent discloses a machine having a plurality of spiral conveyors or augers each with a spiral flight fixed to the core shaft thereof. Each auger has a trowelling mandrel secured to the downstream end thereof so that it rotates with the auger. A vibrator is mounted on the machine outside the molding area thereof so that the entire machine is vibrated, and the vibrations are not where they should be for the best results, and they are also applied to the part of the finished product within the machine. As each trowelling unit is fixed to an auger and rotates with it, it is only possible to form cores in the concrete slabs of circular cross-section and no other cross-sectional shape.

An extrusion machine in accordance with the present invention includes at least one spiral conveyor in and extending longitudinally of the mold of the machine for moving the concrete under pressure longitudinally thereof. A forming element of any predetermined cross-sectional shape is aligned or substantially aligned with the down-stream end of the spiral conveyor and is mounted so as not to rotate with the latter. As a result of this, the forming element can have any desired cross-sectional shape in order to produce cores in the finished product of corresponding cross-sectional shape. The mounting of the forming element makes it possible to rotate the forming element in the same direction as or counter to the direction of rotation of the spiral conveyor, and at the same or a different speed. If it is desired to make a slab with cores of a different cross-sectional size or shape, it is only necessary to replace the forming element.

Additionally, should it be required to form solid slabs this can be achieved simply by removing the core forming element which of course is not possible with existing machines in which the spiral conveyor is formed integrally with the core forming element. It It is preferable to provide a vibrator within the forming element so that the vibrations are imparted to the concrete at the time the latter is being pressed against the formed part of the slab. This vibrator can be operated with less power than the vibrator of the prior art because it does not have to shake or vibrate the entire machine.

The forming element can be made long enough to form or polish the inner surface of each core after the slab has been formed but while it is still within the mold, or it can include one or more finishing sections or elements fixedly or removably secured to the downstream end of the main forming element, and it is preferable to provide vibration dampeners between the forming element sections so that the vibrations within the forming element are not transferred to the finishing elements or sections and therefore are not transferred to the finished portion of the slab.

An extrusion machine according to the present invention comprises means for feeding concrete to a mold, a rotatable spiral conveyor in and extending longitudinally of the mold in the machine for moving said concrete under pressure through the mold and against the concrete that has set into the cross-sectional shape dictated by the cross-sectional shape of the mold, and a forming element of any predetermined cross-sectional shape substantially aligned with the down-stream end of the spiral conveyor and mounted so as not to rotate with the latter. The conveyor moves the material under pressure over the forming element so that said element forms a core of said predetermined cross-sectional shape in the article as it is being formed. The spiral conveyor has a spiral flight wound around a core shaft, said flight preferably being fixed to or formed with the shaft. Although not necessary for some purposes, it is preferable to provide a vibrator within the forming element so as to subject the concrete to high frequency vibrations at the time it is being subjected to the maximum amount of pressure and is being pressed against the portion of the slab already formed. In addition, it is preferable to provide one or more finishing elements or sections secured to the downstream end of the forming element through vibration dampeners. These finishing elements have a cross-sectional shape and size the same as that of the forming element.

The conveyor preferably has those flights closer to the core forming element of slightly greater diameter than the ones more remote from that element although the core shaft is conventionally of larger diameter in that region. In this way the compression of the concrete into the mold region is increased. To further increase the compression the leading face of the flights in the region of the mold may be radial to the core shaft i.e. they may be sectional as opposed to the normal helicoidal flights. In this way the tendancy for the concrete to move up and over those flights is reduced.

Additionally the edges of the core forming element adjacent to the conveyor may be chamfered or relieved so that the element tapers from the desired final cross-section to a lesser cross-section adjacent the conveyor in this way to allow the concrete to be packed smoothly around the element.

Additionally or alternatively the pitch of the flights may be progressively decreased towards the mold or downstream end of the conveyor to such an arrangement as is possible to use a parallel sided core shaft.

Figure 2:
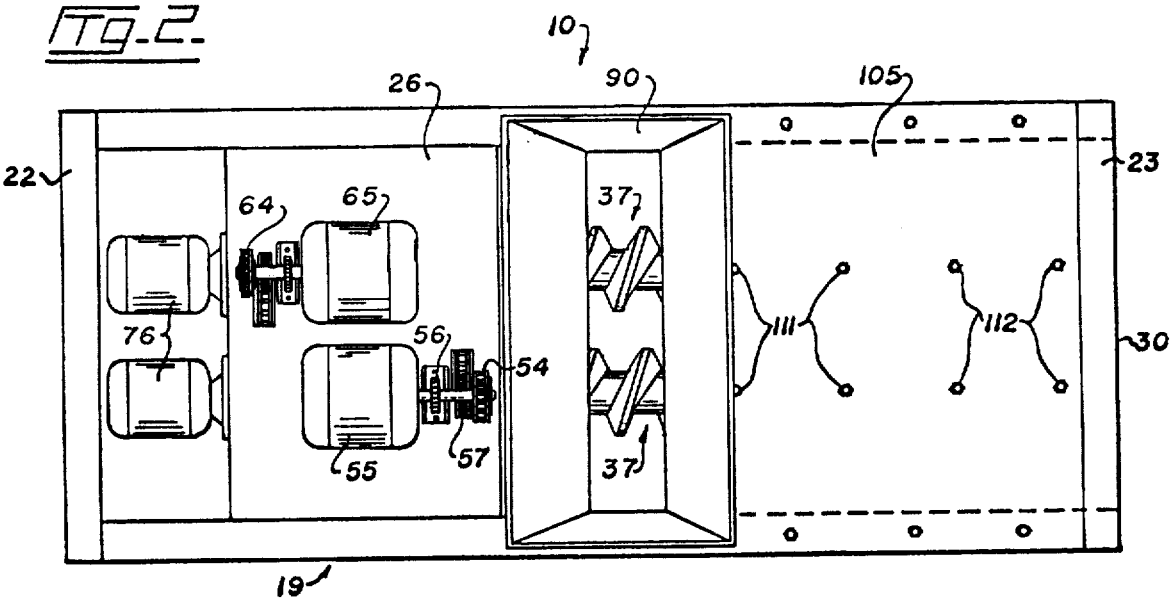
Figure 5:
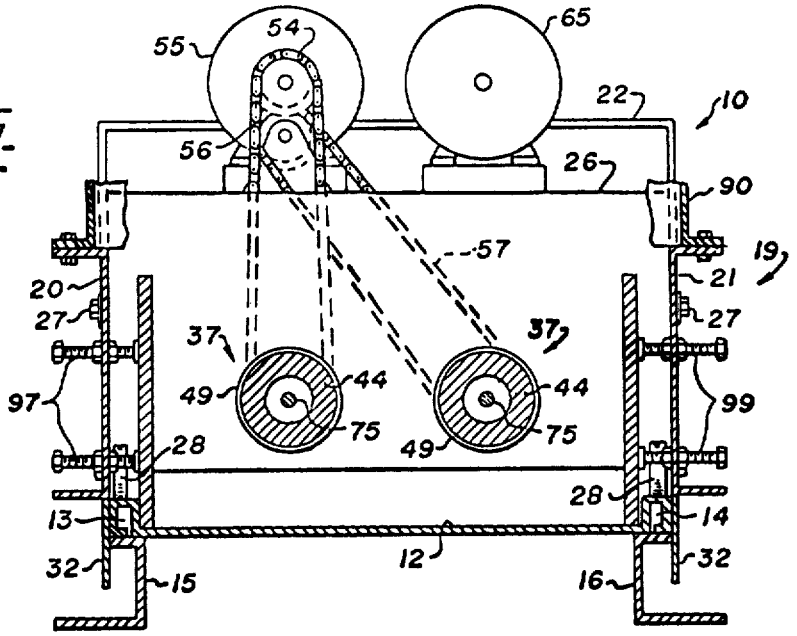
Figure 6:
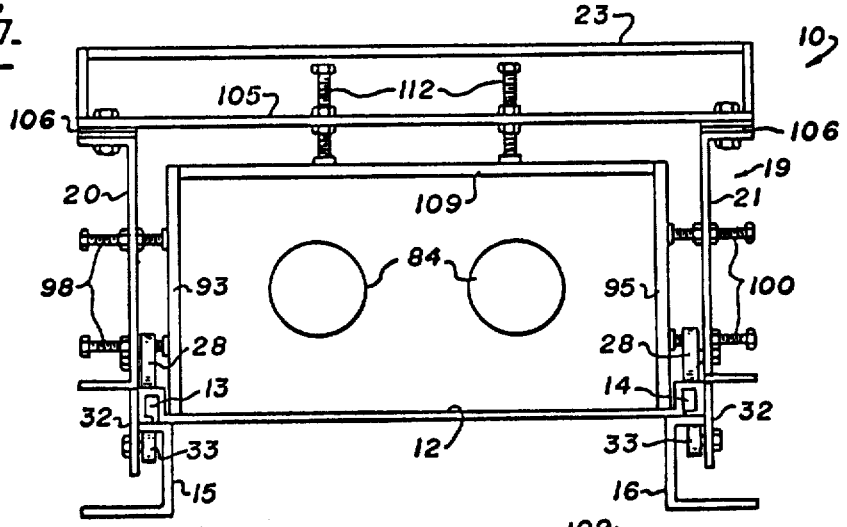
Figure 8:
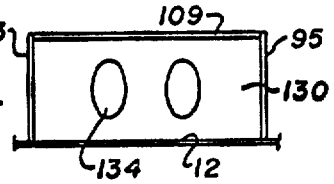
Figure 9:
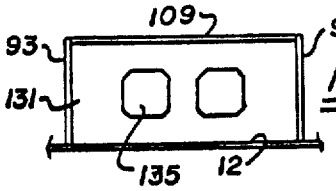
Figure 10:
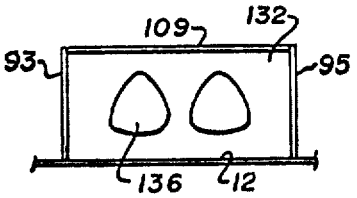
Figure 11:
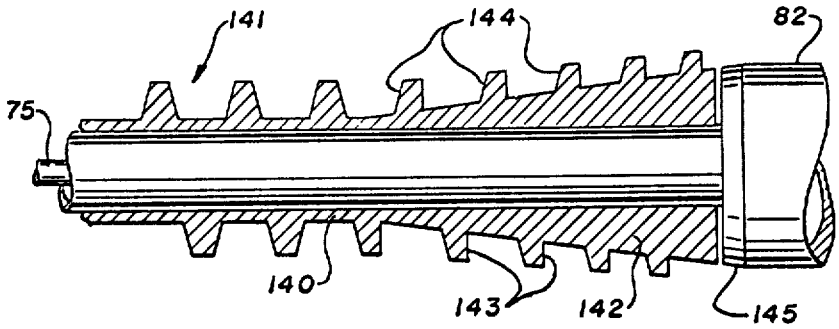

Examples of machines in accordance with this invention are illustrated in the accompanying drawings, in which FIG. 1 is a side elevation of this extrusion machine with the near side broken away to show a spiral conveyor and its associated forming element, FIG. 2 is a plan view of the machine illustrated in FIG. 1, FIG. 3 is a horizontal section taken substantially on the line 3—3 of FIG. 1, showing two spiral conveyors in plan, FIG. 4 is an enlarged vertical longitudinal section taken substantially on the line 4—4 of FIG. 3 showing one of the spiral conveyors and part of the forming element thereof in section, FIG. 5 is a cross-section taken on the line 5—5 of FIG. 3, FIG. 6 is an elevation of the downstream end of the machine, FIG. 7 is a longitudinal section through an alternative form of spiral conveyor, FIGS. 8, 9 and 10 are reduced end views of slabs formed by this machine and illustrating cores of three different cross-sectional shapes by way of example, and FIG. 11 is an enlarged longitudinal section through the outer end of a spiral conveyor similar to but a little different than the conveyor of FIG. 4.

Referring to the drawings, 10 is an extrusion machine in accordance with this invention which is adapted to move over any suitable base in order to form articles of moldable material, such as concrete slabs. The articles may be formed on the ground or any other suitable base which actually constitutes the bottom surface of the mold of the machine. In this example, the machine moves along a base 12 having vertical sides 13 and 14 which form rails for the machine, said base being supported in any suitable manner, such as by channels 15 and 16 upon which sides 13 and 14 rest.

Machine 10 is made up of a main frame 19 consisting of side members 20 and 21 interconnected by cross members 22 and 23 at opposite ends thereof. A supporting frame 26 is mounted on side members 20 and 21 between the ends thereof and extends across the machine. Frame 26 can be adjusted up and down relative to main frame 19 by bolts 27. Frame 19 is provided with wheels 28 that ride on rails 13 and 14, and as it is necessary to prevent the down-stream end 30 of the machine from rising during operation of the apparatus, brackets 32 extend downwardly from frame 19, and carry wheels 33 which engage the lower surfaces of sides 13 and 14, see FIG. 6.

If machine 10 is used to form a relatively narrow slab or beam with a single core therein, only one spiral conveyor 37 is mounted therein. However, there are usually several of these conveyors in the machine, two conveyors being shown in the illustrated machine. As the spiral conveyors and the forming elements associated with them are the same as each other, only one will now be described in detail.

The spiral conveyor 37 is mounted at one end in suitable bearings carried by supporting frame 26 between side member 20 and 21. This conveyor is made up of a flight 40 secured to or formed with a hollow core shaft 41. In this example, shaft 41 has a straight section 44 extending throughout part of the length of the conveyor, and a diverging section 45 extending throughout the remainder of the conveyor at the down-stream end 46 thereof. Flight 40 may have a constant outer diameter as illustrated at 49 in FIGS. 1 and 4. Alternatively and as described with reference to FIG. 11 the outer diameter of the flight may be greater at the down-stream end of the conveyor.

Each conveyor 37 is rotated in any suitable manner, and in this example, one conveyor is driven by a chain and sprocket arrangement 54 which is driven by a suitable source of power, such as an electric motor 55 mounted on frame 26. While the other conveyor can be driven by the drive 54, it is preferable to rotate the latter conveyor in the opposite direction by gears 56 and chain and sprocket arrangement 57.

A forming element 62 is located at the down-stream end 46 of conveyor 37, and is mounted so as not to be rotated by the conveyor. In this example, forming element 62 is mounted on the end of a hollow shaft 63 which is carried at its opposite end by supporting frame 26. Shaft 63 can be fixedly mounted or, as shown, it can be mounted for rotation, in which case it is rotated by a chain and sprocket arrangement 64 which is driven by a suitable source of power, such as an electric motor 65. Forming element 62 is fixedly or removably mounted on the end of shaft 63 beyond the outer end of conveyor 37, and in this example, said forming element is mounted on the end of shaft 63 by bolts 66.

Forming element 62 can be of any desirable cross-section if shaft 63 is not rotated, such as oval, square, triangular, and the like or if it is desired to form slabs without a core the element 62 can be removed. However, if shaft 63 is rotated, the forming element will form a core of circular cross-section, in which case, the element itself can be circular in section. The forming element can be no larger in cross-section than the spiral conveyor, as shown or it can be cross-sectionally larger.

It is preferable to provide a vibrator 68 within forming element 62. Any suitable vibrator may be used for this purpose, such as an eccentric vibrator, as shown. In this example, vibrator 68 consists of a body 70 mounted on a shaft 71 which is offset a little from the longitudinal central axis of the body. Shaft 71 is journalled in bearings 72 which are carried by a housing 73 supported within the forming element 62 and having perforations 74 therein. A drive shaft 75 is connected at one end to shaft 71, and extends longitudinally through shaft 63 to a suitable source of power, such as a small electric motor 76 carried by support 26 beyond the end of said shaft 63, see FIG. 1. The bearings 72 are lubricated by oil 79 in forming element 62 which forms a housing or reservoir therefor. The level of this oil is normally kept above the bottom of vibrator body 70 so that the latter splashes the oil to lubricate the bearings. In addition, during operation of vibrator 68, the eccentric body 70 thereof slides over the inner surface of housing 73 and creates a suction through perforations 74 to draw oil therethrough even when the level of the oil is low. In effect there always is a mist of oil within the forming element to keep bearings 72 lubricated.

When the forming element is removed to produce slabs with no core it is apparent that if vibration is required it will be necessary to apply it externally of the body. Such arrangements are well known per se and as such are not described in detail herein. Obviously even with a core forming element external vibration may be applied to the mold as an alternative to or additionally to the internal vibration system illustrated.

Forming unit 62 may be relatively long, or it may be formed in two or more interconnected sections, as shown. The forming element in this case consists of a main section 82 which is connected to and supported by the outer end of shaft 63, and to additional sections 83 and 84. The two additional sections are the same size and shape in cross-section as main section 82, and section 83 is connected by a dampener 86 to section 82, while section 84 is connected to section 83 by a dampener 87. Main section 82 acts as a forming element, while sections 83 and 84 act as finishing elements. Any suitable type of dampener may be used. An example is illustrated in FIG. 4. Each of the dampeners is made up of a resilient block 88 located between the connected sections, and bolts 89 extending from said sections into the block to hold these elements together.

A hopper 90 is mounted on frame 19 above the inner end of spiral conveyor 37. This hopper directs previously-mixed concrete of the desired consistency down into the area between the sides of frame 19 at the inner end of the spiral conveyor or conveyors. There are usually a plurality of these conveyors in apparatus of this type. The width of the slab to be produced is determined by side plates on edge mounted on opposite sides of the spiral conveyors. There may be one or a plurality of plates at each side. In this example, there are two substantially aligned plates 92 and 93 on one side of the machine, and substantially aligned plates 94 and 95 at the opposite side thereof. Plates 92, 93, 94 and 95 are mounted for adjustment on frame side members 21 and 22 by means of bolts 97, 98, 99 and 100, respectively. The plates can be moved towards and away from the side members by these bolts. Plates 92 and 94 are usually inclined slightly towards each other in the direction of the down-stream or discharge end of the machine, while plates 92 and 93 are usually inclined towards each other in the same direction but to a lesser extent. The distance between the discharge ends of plates 93 and 95, indicated at 102, determines the width of the finished product.

A support 105 extends across the machine above the conveyors and forming elements thereof and are mounted on side members 20 and 21 and adjustable vertically thereto by shims and bolts 106. One or more horizontal top plates are suspended from support 105 above said conveyors and forming elements. In this example, top plates 108 and 109 are adjustably suspended by bolts 111 and 112 respectively. Side plates 92, 93, 94 and 95 and top plates 108 and 109 for the sides and top of a mold 115 for forming the concrete articles or slabs, the surface on which machine 10 operates forming the bottom of this mold, and in this example, base 12 serves this purpose.

During operation, pre-mixed concrete of the desired consistency is fed by the hopper 90 into the space immediately therebelow. This concrete fills the mold 115, engulfing the spiral conveyors and the associated forming elements. As the conveyors rotate, they tend to move the concrete towards the discharge end of the machine, but as this movement is resisted and stopped by the portion of the slab already formed, the concrete is subjected to pressure as it moves through the mold, and the machine moves in the opposite direction. The pressure in the concrete depends upon the force necessary to move the mass of the machine. The pressure can be regulated by changing the angles of side plates 92, 93, 94 and 95, and/or of top plates 108 and 109. The concrete is also moved around the sections 82, 83 and 84 of the forming elements as it travels towards the discharge end of the machine.

As the concrete is moved around the forming elements these form cores in the finished product of the same cross-sectional shape and dimensions as the forming elements. The vibrators operate within the forming elements, and this subjects the concrete to high frequency vibrations as it is being compacted into the finished article. This improves the compaction, and if prestressing strands or cables extend through the machine so as to be incorporated into the finished slab, the vibration within the concrete mass assures a very strong bond between the strands or cables and the concrete. The compaction is so good as a result of the vibrators within the concrete that the finished slab or article is immediately self-supporting.

The finishing sections 83 and 84 support the concrete within the cores formed therein while the concrete is still being subjected to external pressure. They also help to finish or smooth the surfaces of the cores within the slabs. If the complete forming element is circular in cross-section, it can be rotated at the same or different speed from the speed of rotation of the spiral conveyors, and in the same direction as or opposite to the direction of rotation of said conveyors. This makes it possible to rotate the conveyors and the forming elements at the best speeds for their respective purposes. The rotating finishing sections of the forming elements polish the surfaces of the cores. Dampeners 86 and 87 prevent the vibrations from the vibrators from being transferred to finishing sections 83 and 84 and, therefore, to the finished portion of the slab.

FIG. 7 illustrates an alternative form of conveyor **37*a* which has a tubular core shaft 120 which does not have a diverging outer section similar to section 45 on shaft 41. Conveyor 37*a* includes a spiral flight 122 wound around and secured to shaft 120. Conveyor shaft 120 is rotated in the same manner as conveyor shaft 41** described above.

In the example of FIG. 7, forming element 62 is mounted on the end of a tubular shaft 125 which may be fixedly mounted in the machine, or it may be rotated by the same drive means as shaft 63 of conveyor 37. The remaining elements of conveyor **37*a* are the same as those of conveyor 37,** and the two conveyors operate in the same manner.

Machine 10 is such that suitable reinforcing rods may extend therethrough so that the rods are incorporated in the concrete slabs as the latter is formed. Similarly, prestressing strands or cables can extend through the machine, in which case these are incorporated in the slab. By having the vibrators within the forming element, the high frequency vibrations are applied to the concrete exactly where they are required and where they will do the most good. These vibrations also cause the concrete to bond very firmly to the prestressing strands or cables.

The mounting of the forming elements so that they can remain stationary while the spiral conveyors rotate makes it possible to form cores of any desired cross-sectional shape within the concrete slab. For example, these forming elements may be cylindrical, square, oval or any other suitable shape in section. FIGS. 8, 9 and 10 have been included to illustrate finished slabs 130, 131 and 132 having therein cores 134, 135 and 136 respectively of different cross-sectional shapes. These are examples of different shapes that can be produced. If the forming elements are cylindrical, they can be rotated in the same direction as or counter to the rotation of the conveyors, and they can be rotated at the same or different speeds. Thus, the forming elements can be rotated as desired in order to produce well honed cores in the slabs.

The provision of several finishing sections in the forming elements makes it possible to support the slab internally for a longer period after the slab has been formed around the main forming elements than would normally be possible. The dampeners between the forming element sections prevent the high frequency vibrations from being transferred to the finished slab so that the latter is dimensionally stable regardless of the fact that it has just been formed and has just emerged from the forming mold.

Another advantage of the present machine results from the fact that the forming elements can be easily and quickly removed from the machine without interfering with the spiral conveyors when it is desired to make solid concrete slabs. The side plates 92, 93, 94 and 95 can easily be shifted laterally in order to produce slabs of different widths, while top plates 108 and 109 can be adjusted vertically. This machine can be used to produce slabs of different thicknesses and with cores of the same or different sizes. Transverse frame 105 can be adjusted up and down on frame 19 when it is desired to change the thickness of the slab being formed. Frame 26 will also be adjusted up and down to centralize the cores relative to the top and bottom of the slab. If the core size has to be changed, it is not necessary to replace the spiral conveyors but only to replace their associated forming elements. Two layers of cores may be formed in the slab by providing two layers of conveyors and forming elements within the mold of the machine.

In the conveyor illustrated in FIG. 11 the core shaft 140 has flights 141 fixed to it by welding or bolting or by forming them integrally.

The shaft 140 has a diverging section 142 and the flights 141 on that section are of progressively larger diameter towards the core forming element so that their compressure effect on the concrete at that region is increased over the effect of flights which is not so increased. Additionally, while the flights on the parallel sided section of the core shaft are of conventional helicoidal form those on the diverging section are of sectional form having those faces 143 towards the core forming element (i.e. the downstream side) radial and those faces 144 remote from that element sloped.

This feature tends to resist the movement of the concrete up and over the faces 143 and thus further increase the compressure effect of the conveyor. To "lead" the concrete into the mold the end of the core forming element adjacent to the conveyor is chamfered or tapered as at 145.

Desirably the pitch of the flights becomes less towards the downstream end of the conveyor, as shown, and this characteristic may be combined with the features prescribed above or may replace them.

I claim:

1. A method of making a cured slab of concrete comprising the steps of:

introducing wet concrete into an elongate, substantially horizontal mold comprising an inlet end, an outlet end, an elongated spiral conveyor extending in and spaced from the mold between the inlet end and the outlet end thereof for moving concrete under pressure longitudinally of said mold, and a former element in the mold positioned adjacent the outlet end thereof beyond and immediately downstream of the spiral conveyor and substantially aligned with the spiral conveyor, said former element being approximately the same size or slightly less than the downstream end of the spiral conveyor, said former element being mounted so as to be rotated independently of the spiral conveyor, the cross sectional area of said mold being less at said outlet end than at said inlet end and progressively decreasing in cross-section substantially from the inlet end to the end of the spiral conveyor whereby said concrete is packed under pressure around said former;

forcing the concrete along the spiral conveyor by rotating it to force the concrete onto the former at a progressively increasing pressure as a result of the progressively increasing radial restraint of the mold at the former because of the progressively decreasing cross-sectional area of the mold substantially from the inlet end to the former, said forcing step including extruding the concrete out through the outlet and against the previously formed concrete to move the mold in a direction away from said formed concrete, and rotating the former during said forcing step independently of the speed or direction of rotation of the spiral conveyor so as to select a speed for optimizing the properties of the interior surface of the core.

2. A method according to claim 1 wherein the machine is permitted to move in a direction opposite to the direction of motion of the concrete through said oiutlet end by reaction of the fresh concrete being moved against the previously formed slab whereby the machine moves in said direction relative to a surface onto which the concrete slab is extruded.

3. A method as claimed in claim 1 wherein said forcing step includes rotating a plurality of said spiral conveyors located in the mold, each having one of said former elements in axial alignment therewith, said spiral conveyors being substantially parallel and co-planar and spaced apart to form a concrete slab having a plurality of spaced apart and parallel cores.

4. A method as claimed in claim 1 including the further step of vibrating from within the former element the concrete in said mold.

5. A method of making a cured slab of concrete comprising the steps of:

introducing wet concrete into an elongate, substantially horizontal mold comprising an inlet end, an outlet end, an elongated spiral conveyor extending in and spaced from the mold between the inlet end and the outlet end thereof for moving concrete under pressure longitudinally of said mold, and a former element in the mold positioned adjacent the outlet end thereof beyond and immediately downstream of the spiral conveyor and substantially aligned with the spiral conveyor, said former element being approximately the same size or slightly less than the downstream end of the spiral conveyor, said former element being mounted so as to be separate from and rotatable independently of the spiral conveyor, the cross-sectional area of said mold being less at said outlet end than at said inlet end whereby said concrete is packed under pressure around said former;

forcing the concrete along the spiral conveyor by rotating it to force the concrete onto the former at a progressively increasing pressure as a result of the progressively increasing radial restraint of the mold at the former because of the smaller cross-sectional area of the mold at the former as compared with the cross-sectional area at the spiral conveyor, said forcing step including extruding the concrete out through the outlet and against the previously formed concrete to move the mold in a direction away from said formed concrete, and including the further step of vibrating the concrete in the mold at a high frequency with a vibrator located within said separated former element such that its high frequency vibrations are imparted to the concrete at said location whereat the concrete is packed under pressure around the former, and wherein the concrete upstream from the former is substantially free of said high frequency vibrations.

6. A method according to claim 5 wherein the machine is permitted to move in a direction opposite to the direction of motion of the concrete through said outlet end by reaction of the fresh concrete being moved against the previously formed slab whereby the machine moves in said direction relative to a surface onto which the concrete slab is extruded.

7. A method as claimed in claim 5 wherein said forcing step includes rotating a plurality of said spiral conveyors located in the mold, each having one of said former elements in axial alignment therewith, said spiral conveyors being substantially parallel and co-planar and spaced apart to form a concrete slab having a plurality of spaced apart and parallel cores.

* * * * *